United States Patent [19]

Eisenkolb

[11] 4,327,647

[45] May 4, 1982

[54] FUNICULAR RAILWAY

[75] Inventor: Klaus Eisenkolb, Linz, Austria

[73] Assignee: Voest-Alpine Aktiengesellschaft, Linz, Austria

[21] Appl. No.: 165,957

[22] Filed: Jul. 3, 1980

[30] Foreign Application Priority Data

Jul. 12, 1979 [AT] Austria ..... 4848/79

[51] Int. Cl.[3] ..... B61B 9/00; B61B 13/12; B61J 3/04

[52] U.S. Cl. ..... 104/174; 104/183; 104/184

[58] Field of Search ..... 104/174, 175, 183, 184

[56] References Cited

U.S. PATENT DOCUMENTS

| | | | |
|---|---|---|---|
| 4,457 | 4/1846 | Lowery | 104/174 |
| 549,701 | 11/1895 | Brown et al. | 104/184 |
| 787,605 | 4/1905 | Acklin | 104/174 |

FOREIGN PATENT DOCUMENTS

| | | | |
|---|---|---|---|
| 63543 | 7/1892 | Fed. Rep. of Germany | 104/174 |
| 1405561 | 10/1963 | Fed. Rep. of Germany | 104/174 |

*Primary Examiner*—Joseph F. Peters, Jr.
*Assistant Examiner*—Howard Beltran
*Attorney, Agent, or Firm*—Kurt Kelman

[57] ABSTRACT

First and second cars are movable on an inclined track and adapted to bypass each other at an intermediate turnout of the track. A traction cable is trained around a reversing pulley at the upper end of the track and has two courses extending along the track and connected to respective ones of the cars and to move the cars in opposite directions along the track. Two sets of guide pulleys guide respective ones of said cable courses. The guide pulleys of each set are spaced along the track. The two sets of guide pulleys are disposed on opposite sides of the track therebelow and outside the rails thereof and guide the cable courses so that they extend on opposite side of the track outside the rails thereof.

1 Claim, 5 Drawing Figures

FUNICULAR RAILWAY

Figure 1:
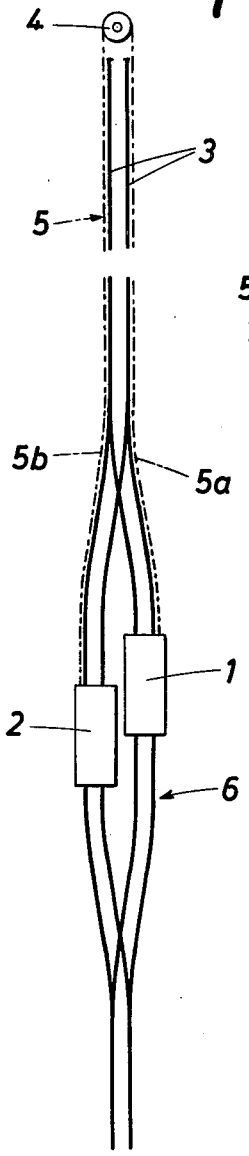

This invention relates to a cable railroad, particularly to a cable railroad having a continuous inclined track bridge, which railroad comprises two cars movable in opposite directions along a track having a turnout and are connected by a common traction cable trained around an upper reversing pulley and guided by guide pulleys spaced along the track.

Cable railroads comprise a traction cable which connects the two cars, is trained at a top station around a reversing pulley and is usually guided to extend between the two rails for the cars. A cable extending between the rails will cross two rails in the middle of the length of the track at the turnout which permits the uphill and downhill cars to bypass each other. This crossing of the rails by the cable requires gaps in the rails at the crossings. The conventional traction cable arrangement gives rise to difficulties not only at the turnout but also in steep curves because the space between the rails and the underside of the car is so small that the guide pulleys cannot be properly positioned. Specifically, there are restrictions as regards the provision of inclined pulleys. In the known cable railroads, the track must not be laid so that the traction rope would lift off the guide pulleys because the cars could not move over the holding-down pulleys which would be required for the cable. It is known that the difficulties relating to the arrangement of the cable near the turnout can be avoided if the two cars are guided one over the other rather than one beside the other at the siding. For this purpose the continuous rails descend adjacent to the turnout and are bridged there by a wider track and one car has an additional wheel set for the wider track. The car having the additional wheel set is guided on the wider track above the lowered rails and the other car moves on the lower rails below the upper car at the turnout.

To ensure that the traction cable connecting the cables is not hindered, that course of the traction cable which is connected to the upper car extends outside the continuous track and that course of the traction cable which is connected to the lower car extends between the two rails. Whereas such a cable arrangement may be of advantage for this special turnout, it cannot solve the problems relating to the cable arrangement near the conventional turnout because in that case the cable must cross the rails and the traction cable course laid between the two rails remains subjected to all restrictions so that the arrangement of the track will be restricted by the restrictions regarding the arrangement of the guide pulleys.

It is an object of the invention to avoid these difficulties and so to improve a cable railroad of the kind described first hereinbefore that the cable need not cross the rails and the track can be arranged as desired whereas the most favorable arrangement of the guide pulleys can be selected.

This object is accomplished according to the invention by laying the two courses of the traction cable which are connected to respective cars on opposite sides of the track on the guide pulleys positioned outside the two rails and therebelow along the length of the track.

Because the two traction cable courses connected to respective cars are laid outside the two rails, there will be no crossing between the rail and the cable near the turnout because even near the turnout the traction cable courses can be laid outside the two juxtaposed tracks. As a result, the cable arrangement adjacent to the turnout is simpler and more reliable. Because with that cable arrangement the guide pulleys are disposed outside the rails, there is adequate space permitting the guide pulleys to be arranged with the optimum inclination at bends of the track. This great latitude regarding the arrangement of the guide pulleys permits also track arrangements in which the courses of the traction cable tend to lift off the guide pulleys; such lifting can now be prevented by holding-down pulleys for the cable courses. If holding-down pulleys are provided, it is merely necessary to use suitable means for connecting the cable to the car so that the latter can move past the holding-down pulleys. These requirements can be met in a simple manner if the cable is connected to the car by an arm which laterally protrudes from the car. The means for connecting the cable to the cars may be so designed that the cable is lowered from and returned to the holding-down rollers as the car enters and leaves a track portion provided with holding-down pulleys.

A particularly simple structure will be obtained if the guide pulleys are mounted in a preferred manner on both sides of the truss of the continuous track bridge. In that case the cable courses can be arranged below the track level so that the guide pulleys can be arranged with various inclinations without a substantial structural expenditure, and all requirements to be met by the cable arrangement can be fulfilled by the selection of different arrangements of the guide pulleys.

Figure 3:
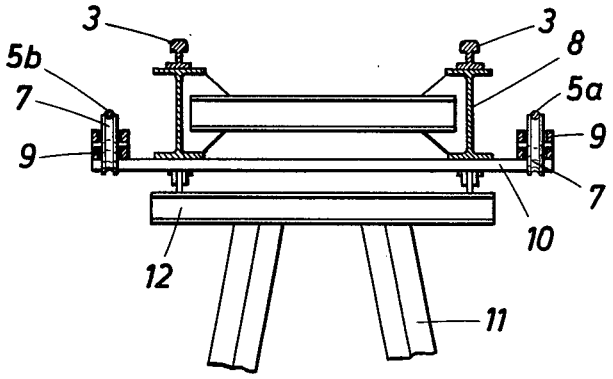
Figure 4:
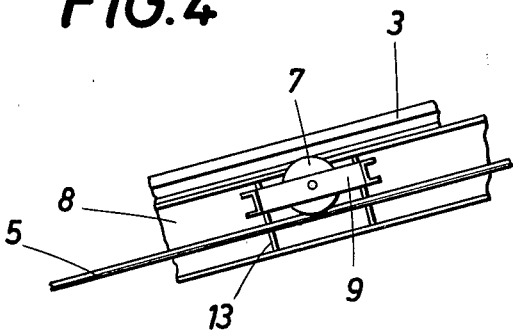
Figure 2:
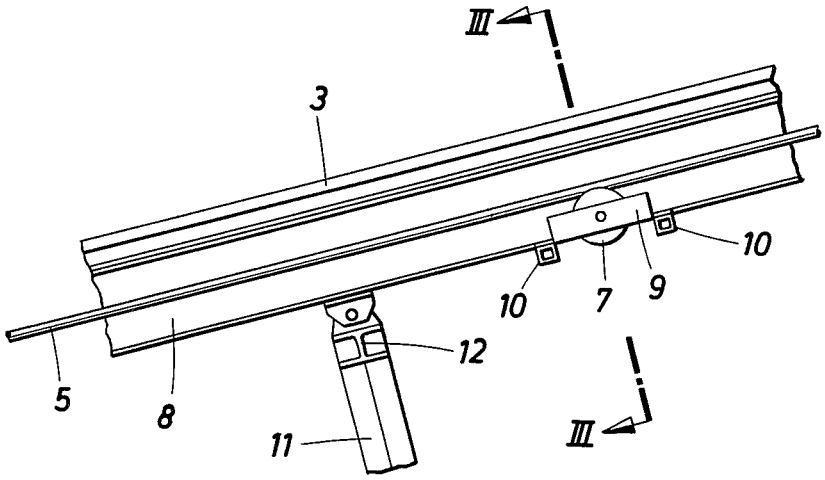
Figure 5:
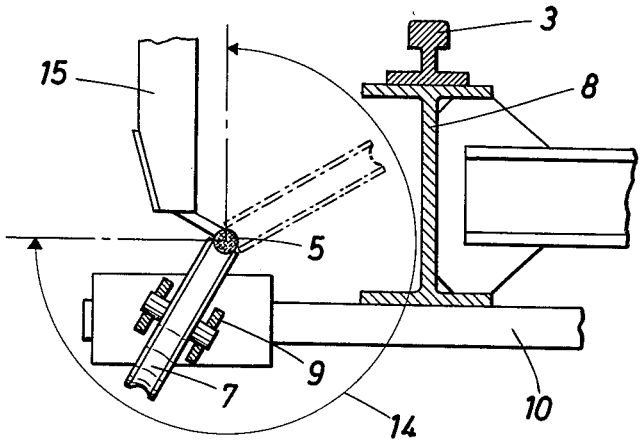

An illustrative embodiment of the invention is shown by way of example on the drawing, in which FIG. 1 is a highly simplified top plan view showing a cable railroad according to the invention, FIG. 2 is a side elevation showing a guide pulley arranged in accordance with the invention, FIG. 3 is a sectional view taken on line III—III in FIG. 2, FIG. 4 is a side elevation showing a possible arrangement of a holding-down pulley for guiding the cable and FIG. 5 is an enlarged transverse sectional view showing the truss of a track bridge of a cable railroad with an inclined guide pulley near a bend of the track.

As is apparent from FIG. 1, the illustrated cable railroad comprises two cars 1 and 2, movable on rails 3 and connected by a traction cable 5 trained around a reversing pulley 4 near the top station. A siding 6 is provided at the center of the length of the track formed by the rails 3 and permits the uphill and downhill cars 1 and 2 to bypass each other. To eliminate crossings beween the traction cable 5 and the rails 3 at the turnout 6, the two traction cable courses 5*a* and 5*b* connected to respective cars are laid on opposite sides of the track outside the two rails. The traction cable courses 5*a* and 5*b* are guided by guide pulleys 7, which are mounted on both sides of the truss 8 of a continuous track bridge outside the two rails. In the arrangements shown in FIGS. 2 and 3, the traction cable 5 simply rests on the guide pulleys 7 so that only the weight of the cable must be taken up by the guide pulleys 7. For this reason, the guide pulleys 7 mounted in bearings 9 are fixed only to crossbars 10, which extend transversely to the longitudinal direction of the truss 8 and are secured to the underside of the truss 8 and laterally protrude from the latter. The truss itself is supported in the conventional manner by socketed stanchions 11 which have crossarms 12, to which the truss 8 is secured.

When holding-down pulleys for the cable are required, the guide pulleys must be accessible from below so that brackets 13 arranged on the sides of the truss 8 are desirable. This is indicated in FIG. 4. Bearings 9 for mounting the guide pulleys 7 can be secured in conventional manner to brackets 13.

In FIG. 5, an angular range 14 is indicated, which represents the range of the inclinations with which the guide pulleys 7 can be arranged. That range is determined by the special design of arms 15, by which the traction cable 5 is connected to respective cars 1 and 2 and which laterally protrude from said cars. It is apparent from FIG. 5 that the lateral arrangement of the guide pulleys 7 beside the truss 8 of the continuous track bridge of a cable railroad permits an arrangement of each guide pulley with the optimum inclination so that all requirements regarding the optimum cable arrangement can be met. This ensures a defined cable arrangement in bends as well in track portions in which the cable courses tend to lift off the track.

What is claimed is:

1. In a cable railroad: the combination of (a) an inclined length of track having an intermediate turnout forming parallel portions and an upper end, (b) a reversing pulley at the upper end of the length of track, (c) a pair of cars movable along the length of track and the turnout permitting the cars to bypass each other, (d) a traction cable having respective ends connected to exterior sides of the cars and being trained around the reversing pulley to form two courses extending exteriorally along the track, operation of the traction cable causing the cars to move along the track in opposite directions, and (e) two sets of guide pulleys spaced along the entire length exteriorally of the track, a respective one of the sets of guide pulleys guiding each traction cable course, the track having two rails and the two sets of guide pulleys being disposed on opposite sides of the track and therebelow outside the track rails whereby the cable courses extend outside the track throughout its length.

* * * * *